US011420800B2

(12) United States Patent
Laflamme

(10) Patent No.: US 11,420,800 B2
(45) Date of Patent: Aug. 23, 2022

(54) PACKAGING SYSTEM AND METHOD OF USING SAME

(71) Applicant: Karine Laflamme, Saint-Lin-Laurentides (CA)

(72) Inventor: Karine Laflamme, Saint-Lin-Laurentides (CA)

( * ) Notice: Subject to any disclaimer, the term of this patent is extended or adjusted under 35 U.S.C. 154(b) by 0 days.

(21) Appl. No.: 17/088,290

(22) Filed: Nov. 3, 2020

(65) Prior Publication Data

US 2022/0135300 A1 May 5, 2022

(51) Int. Cl.

| | |
|---|---|
| ***B65D 65/10*** | (2006.01) |
| ***B65B 11/00*** | (2006.01) |
| ***B65D 65/22*** | (2006.01) |

(52) U.S. Cl.

CPC ..... *B65D 65/10* (2013.01); *B65B 11/004* (2013.01); *B65D 65/22* (2013.01)

(58) Field of Classification Search

CPC ..... B65D 65/10; B65D 65/22; B65B 11/004
USPC ..... 229/87.01
See application file for complete search history.

(56) References Cited

U.S. PATENT DOCUMENTS

| | | | | | |
|---|---|---|---|---|---|
| 1,123,609 | A * | 1/1915 | Spesha | B65D 81/3886 | 206/304 |
| 1,385,695 | A | 7/1921 | Maccormack et al. | | |
| 2,734,543 | A * | 2/1956 | Hunter | A61F 15/001 | 229/87.01 |
| 2,766,797 | A * | 10/1956 | Cowen | A01G 20/40 | 383/4 |
| 3,623,526 | A | 11/1971 | Robertson | | |
| 3,683,987 | A | 8/1972 | Robertson | | |
| 3,958,751 | A * | 5/1976 | Bruno | B65D 65/22 | 229/87.08 |
| 3,967,668 | A * | 7/1976 | Franco | B65D 75/14 | 383/92 |
| 4,566,592 | A | 1/1986 | Klukos | | |
| 4,726,509 | A * | 2/1988 | Fonas | B65D 5/4262 | D9/635 |
| 5,004,144 | A | 4/1991 | Selga | | |
| 5,373,942 | A * | 12/1994 | Weder | B29C 51/08 | 53/399 |

(Continued)

FOREIGN PATENT DOCUMENTS

| | | |
|---|---|---|
| AU | 2015203850 | 1/2016 |
| EP | 3447002 | 4/2020 |

(Continued)

*Primary Examiner* — Peter N Helvey

(57) ABSTRACT

A reusable packaging system for a gift, comprising: a decorative wrapping for wrapping around the gift so that the gift is concealed thereby, the decorative wrapping defining a plurality of mounting apertures; and a mount securable to the gift independently from the decorative wrapping, the mount being provided with a wrapping attachment insertable in each of the mounting apertures. The decorative wrapping is movable between attached and detached configurations. In the detached configuration, the decorative wrapping is detached from the mount. In the attached configuration, with the mount secured to the gift, the decorative wrapping is attached to the mount and encloses the gift, the decorative wrapping being secured to the wrapping attachment with the wrapping attachment inserted through at least some of the mounting apertures.

18 Claims, 3 Drawing Sheets

(56) References Cited

U.S. PATENT DOCUMENTS

| | | | | |
|---|---|---|---|---|
| 5,392,983 | A * | 2/1995 | Clarke-Bolling | B65D 67/00 229/87.01 |
| 5,407,125 | A | 4/1995 | Yates | |
| 5,529,395 | A * | 6/1996 | French | B65D 65/08 383/118 |
| 5,743,458 | A * | 4/1998 | French | B65D 65/02 383/118 |
| 5,850,963 | A | 12/1998 | Chang | |
| 5,934,548 | A | 8/1999 | Kenyon | |
| 5,979,744 | A * | 11/1999 | Brigleb | B65D 67/00 229/87.01 |
| 6,241,389 | B1 * | 6/2001 | Gilmore | B65D 33/28 383/117 |
| 7,077,308 | B2 * | 7/2006 | Beach | B65D 67/00 383/66 |
| D699,150 | S | 2/2014 | Amidon | |
| 8,783,546 | B2 | 7/2014 | Uyehara | |
| 8,931,242 | B1 * | 1/2015 | Sardo | B65D 33/1625 383/71 |
| 9,365,337 | B2 | 6/2016 | Fullan | |
| D837,065 | S | 1/2019 | Baez | |
| D872,593 | S | 1/2020 | Longobardi | |
| D872,594 | S | 1/2020 | Longobardi | |
| 2004/0026488 | A1 | 2/2004 | Beach | |
| 2007/0041670 | A1 * | 2/2007 | Spizman | B65D 75/006 383/118 |
| 2007/0056870 | A1 * | 3/2007 | Mihailo | B65D 5/425 206/457 |
| 2007/0256949 | A1 * | 11/2007 | Bezar | B65D 77/00 206/457 |
| 2009/0152332 | A1 * | 6/2009 | Childs | B65D 29/00 383/105 |
| 2010/0064634 | A1 * | 3/2010 | Hughes | B65D 67/00 53/399 |
| 2010/0127052 | A1 | 5/2010 | Uyehara | |
| 2010/0127055 | A1 * | 5/2010 | Zelina | B65D 5/4262 229/87.18 |
| 2011/0139323 | A1 | 6/2011 | Yamada | |
| 2012/0012646 | A1 * | 1/2012 | Bissonnette | B65D 65/22 53/461 |
| 2012/0125797 | A1 | 5/2012 | Foye et al. | |
| 2012/0308163 | A1 | 12/2012 | Palmer et al. | |
| 2013/0186782 | A1 | 7/2013 | Doyle | |
| 2013/0186896 | A1 | 7/2013 | Doyle | |
| 2015/0232245 | A1 | 8/2015 | Fullan | |
| 2017/0259973 | A1 | 9/2017 | Crossno | |
| 2021/0130054 | A1 * | 5/2021 | Margaritis | B65D 65/10 |
| 2021/0171258 | A1 * | 6/2021 | Sawicki | B65D 67/00 |
| 2022/0073245 | A1 * | 3/2022 | Downey | B65D 65/04 |

FOREIGN PATENT DOCUMENTS

| | | |
|---|---|---|
| GB | 331129 | 6/1930 |
| GB | 2495773 | 4/2013 |
| GB | 2520042 | 9/2016 |
| WO | 2000064762 | 11/2000 |

* cited by examiner

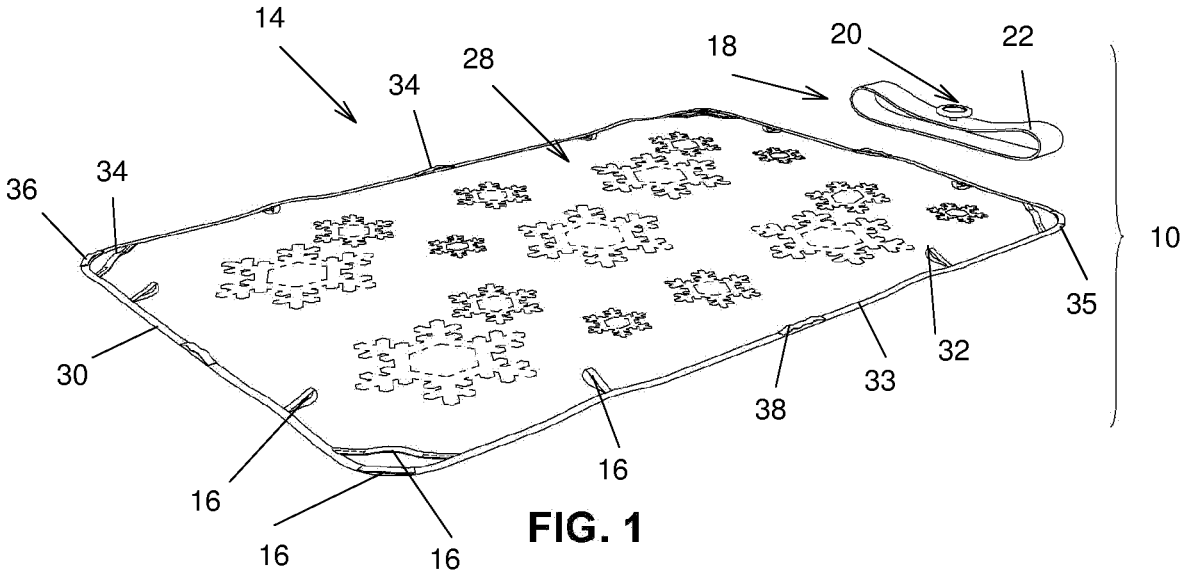
FIG. 1
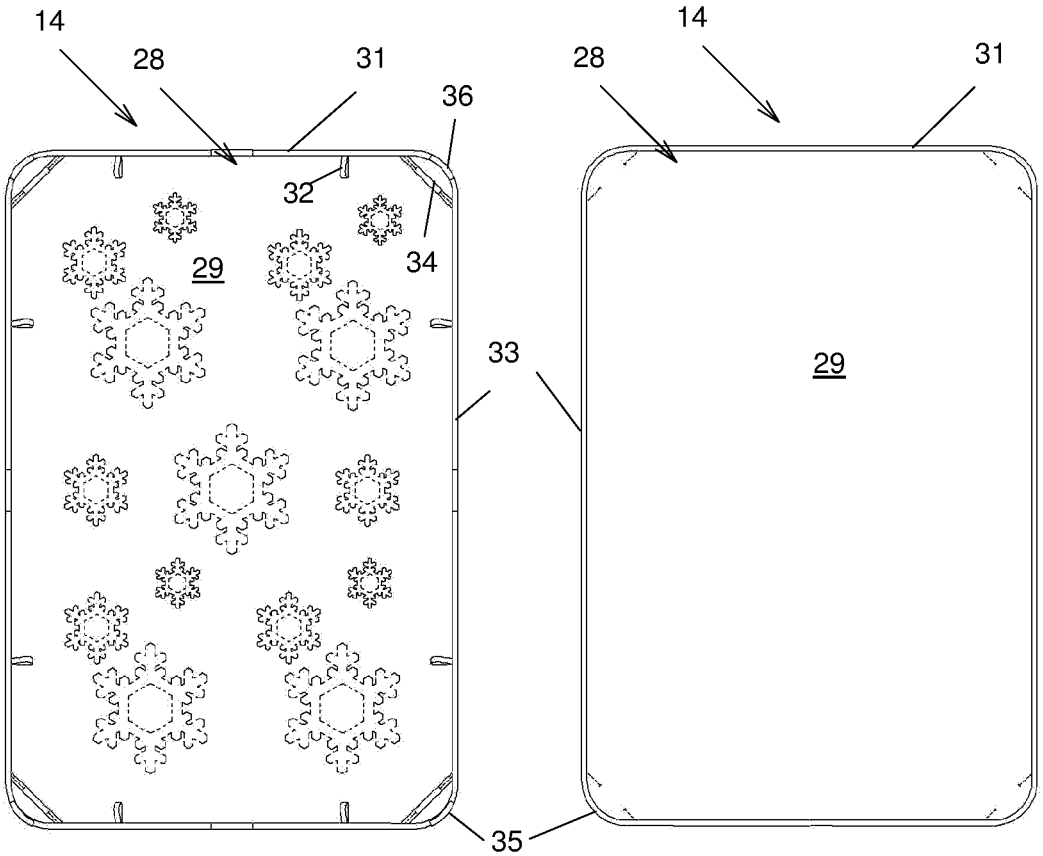
FIG. 2
FIG. 3

PACKAGING SYSTEM AND METHOD OF USING SAME

FIELD OF THE INVENTION

The present invention relates to the general field of packaging and is more specifically concerned with a packaging system.

BACKGROUND

It is common to wrap gifts with wrapping paper. However, using paper to wrap the gift leads to waste as the paper is usually torn while the gift is unwrapped. The wrapping paper can therefore not be used again. Also, even if the paper would be carefully unwrapped to avoid damage, only similarly sized items can be wrapped with the piece of wrapping paper. In addition, wrapping a gift with wrapping paper skillfully is not an easy task. Irregular folds and paper that is not completely flat against the item are common even for simple for box-shaped items wrapped by inexperienced wrappers. When the shape of the item is irregular, it is even more difficult to achieve an aesthetically pleasant result.

Against this background, there exists a need in the industry to provide devices and method to mitigate the above-noted disadvantages of existing packaging devices and methods. An object of the present invention is therefore to provide such devices and methods.

SUMMARY OF THE INVENTION

In a broad aspect, there is provided a reusable packaging system for a gift, comprising: a decorative wrapping for wrapping around the gift so that the gift is concealed thereby, the decorative wrapping defining a plurality of mounting apertures; and a mount securable to the gift independently from the decorative wrapping, the mount being provided with a wrapping attachment insertable in each of the mounting apertures. The decorative wrapping is movable between attached and detached configurations. In the detached configuration, the decorative wrapping is detached from the mount. In the attached configuration, with the mount secured to the gift, the decorative wrapping is attached to the mount and encloses the gift, the decorative wrapping being secured to the wrapping attachment with the wrapping attachment inserted through at least some of the mounting apertures.

There may also be provided a reusable packaging system wherein the mount includes a mount loop positionable around the gift, the wrapping attachment being secured to the mount loop.

There may also be provided a reusable packaging system wherein the mount loop is a first mount loop, the mount also including a second mount loop substantially perpendicular to the first mount loop, the first and second mount loops being positionable simultaneously around the gift.

There may also be provided a reusable packaging system wherein the wrapping attachment includes a stem extending away from the mount loop and a flange protruding transversally from the stem, the flange being spaced apart from the mount loop, wherein, in the attached configurations, the stem extends through the at least some of the mounting apertures.

There may also be provided a reusable packaging system wherein the stem is substantially freely deformable.

There may also be provided a reusable packaging system wherein the mount loop is made of a stretchable material.

There may also be provided a reusable packaging system wherein the decorative wrapping includes a fabric panel defining a panel peripheral edge, the decorative wrapping also including a plurality of wrapping bands secured to the fabric panel, each wrapping band at least partially defining a respective one of the mounting apertures.

There may also be provided a reusable packaging system wherein at least one of the wrapping bands is looped to define one of the mounting apertures.

There may also be provided a reusable packaging system wherein the fabric panel is substantially polygonal and defines edges joined to each other by apexes, the at least one of the wrapping bands being provided along one of the edges of the fabric panel.

There may also be provided a reusable packaging system wherein at least one of the wrapping bands extends across part of the fabric panel so that the at least one of the wrapping bands and the fabric panel cooperatively define one of the mounting apertures.

There may also be provided a reusable packaging system wherein the fabric panel is substantially polygonal and defines edges joined to each other by apexes, the at least one of the wrapping bands being provided at one of the apexes of the fabric panel and extending between two of the edges of the fabric panel.

There may also be provided a reusable packaging system wherein at least one of the wrapping bands extends along the panel peripheral edge with a portion thereof unattached to the fabric panel so that the at least one of the wrapping bands and the fabric panel cooperatively define one of the mounting apertures.

There may also be provided a reusable packaging system wherein at least one of the wrapping bands is made of a substantially unstretchable material.

There may also be provided a reusable packaging system wherein decorative wrapping includes a substantially polygonal fabric panel defining a panel peripheral edge, the fabric panel also defining edges joining pairwise at apexes, the fabric panel including a central portion delimited along the panel peripheral edge by a peripheral portion, the central portion being more stretchable than the peripheral portion; and a plurality of wrapping bands secured to the fabric panel, first bands from a first subset of the wrapping bands being each looped and secured to the fabric panel at the edges and each defining one of the mounting apertures, second bands from a second subset of the wrapping bands extending each across part of the fabric panel at the apexes between two adjacent ones of the edges to define one of the mounting apertures cooperatively with the fabric panel, and third bands from a third subset of the wrapping bands extending each along the panel peripheral edge with a detached part thereof that is unattached to the fabric panel, the fabric panel and the detached part together defining one of the mounting apertures.

There may also be provided a reusable packaging system wherein the wrapping bands each have at least a portion thereof secured to the peripheral portion.

There may also be provided a reusable packaging system wherein the wrapping includes a stretchable central portion and a peripheral portion that is less stretchable than the central portion.

In another broad aspect, there is provided a reusable packaging system for an item, comprising a wrapping for wrapping around the item so that the item is surrounded thereby, the wrapping defining a plurality of mounting apertures; and a stretchable mount loop positionable around the item independently from the wrapping, a wrapping attachment insertable in each of the mounting apertures being secured to the mount loop, the wrapping attachment including a stem extending away from the mount loop and a flange protruding transversally from the stem, the flange being spaced apart from the mount loop. The wrapping is movable between attached and detached configurations. In the detached configuration, the wrapping is detached from the mount. In the attached configuration, the wrapping is attached to the mount and encloses the item with the mount secured to the gift and with the wrapping secured to the wrapping attachment with the stem inserted through at least some of the mounting apertures.

There may also be provided a reusable packaging system wherein the wrapping is stretchable.

There may also be provided a reusable packaging system wherein the wrapping includes a thermally insulating layer sandwiched between two fabric layers.

In yet another broad aspect, there is provided a method of using the reusable packaging system as described above, comprising: laying open the decorative wrapping; mounting the mount to the gift to make a mounted gift; laying the mounted gift on the decorative wrapping; and after laying the mounted gift on the decorative wrapping, folding the decorative wrapping over the gift and inserting successively the wrapping attachment through some or all of the mounting apertures until the decorative wrapping conceals the gift.

Advantageously, in some embodiments, the proposed system is relatively inexpensive to manufacture and can be reused to reduce wastes caused by disposable wrappings. Also, in some embodiments, the proposed packaging system can be made of washable materials to further extend the life of the packaging system. The proposed packaging system also may provide many mounting apertures and include stretchable materials to increase flexibility in the shapes and dimensions of items wrappable with a single one of the systems. Yet furthermore, the proposed system allows to achieve a pleasant aesthetic aspect for the wrapped gift relatively easily, and may also allow to wrap together more than one items relatively easily.

Other objects, advantages and features of the present invention will become more apparent upon reading of the following non-restrictive description of some embodiments thereof, given by way of example only with reference to the accompanying drawings.

BRIEF DESCRIPTION OF THE DRAWINGS

FIG. 1, in a perspective view, illustrates an embodiment of a packaging system according to the present invention, here shown in a detached configuration;

FIG. 2, in a top plan view, illustrates a wrapping part of the packaging system of FIG. 1;

FIG. 3, in a bottom plan view, illustrates the wrapping of FIG. 2;

DETAILED DESCRIPTION

The terms "substantially" and "about" are used throughout this document to indicate variations in the thus qualified terms. These variations are variations that do not materially affect the manner in which the invention works and can be due, for example, to uncertainty in manufacturing processes or to small deviations from a nominal value or ideal shape that do not cause significant changes to the invention.

Many items in the present document are described as being stretchable. Such items should be understood as having material properties allowing an intended user to manually, without any tool, resiliently deform the item so that the item is non-permanently stretched by a significant amount in at least one direction and can, when external forces are removed, return to its original shape. Such stretchable items may show in some embodiments a non-linear behavior in which it becomes very difficult to stretch the item more than a predetermined amount, or impossible to do so without damaging the item. In some embodiments, a stretchable item can be stretched by one of 10%, 20%, 25%, 50% or 100% before this is achieved, but other values are within the scope of the invention. In contrast, materials referred to as unstretchable have opposite properties, and cannot be stretched to any significant extent before being irreversibly damaged. For example, a maximal extension of less than 5%, less than 10% or less than 20% before irreversible damage can be considered to characterize an unstretchable material. In all embodiments including both a stretchable material and an unstretchable material, the unstretchable material is less stretchable than the unstretchable material by a significant amount, for example and non-limitingly by a factor of 2 or a factor of 5, before irreversible damages are caused.

Figure 13:
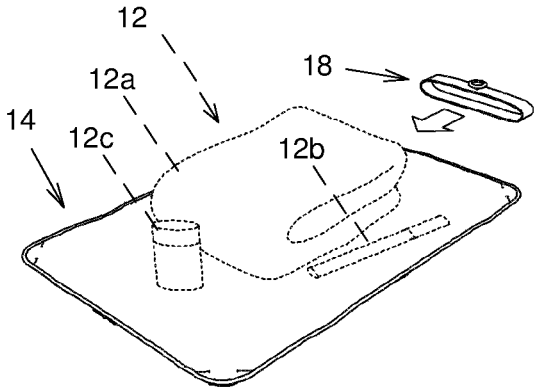
FIG. 13, in a perspective view, illustrates a step in use of the system of FIG. 1 to wrap a gift.

Referring to FIG. 1, there is shown a reusable packaging system 10 for an item, such as a gift 12 (seen for example in FIG. 13). While the present description mostly refers to gift wrapping, some embodiments of the reusable packaging system 10 are usable to wrap any other type of item of appropriate dimensions. The packaging system 10 includes a decorative wrapping 14 for wrapping around the gift 12 so that the gift 12 is concealed thereby. The decorative wrapping 14 may be provided with printed or otherwise formed designs to enhance the decorative aspect of the decorative wrapping 14, but uniformly colored decorative wrappings 14 are also usable. The decorative wrapping 14 defines a plurality of mounting apertures 16. The packaging system 10 also includes a mount 18 securable to the gift independently from the decorative wrapping 14. The mount 18 is provided with a wrapping attachment 20 insertable in each of the mounting apertures 16.

Figure 16:
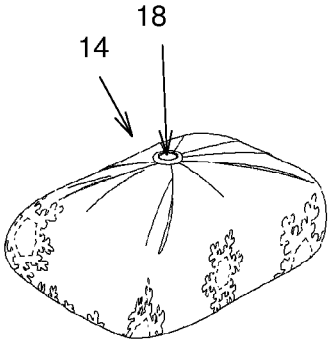
FIG. 16, in a perspective view, illustrates yet another step in use of the system of FIG. 1 to wrap a gift.
Figure 17:
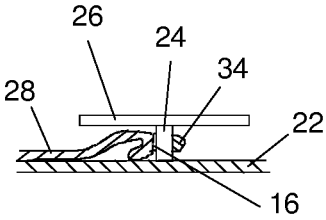
FIG. 17, in a side partially cross-sectional view, illustrates mounting of an attachment band part of the wrapping of FIG. 2 to a wrapping attachment part of the mount of FIG. 6.

The decorative wrapping 14 is movable between attached and detached configurations. In the detached configuration, as seen in FIG. 1 for example, the decorative wrapping 14 is detached from the mount 18. In the attached configuration, as seen in FIG. 16, with the mount 18 secured to the gift 12, the decorative wrapping 14 is attached to the mount 18 and encloses the gift 12, which is therefore no longer visible. The decorative wrapping 14 is secured to the wrapping attachment 20 with the wrapping attachment 20 inserted through at least some of the mounting apertures 16, as seen for example in FIG. 17.

Figure 10:
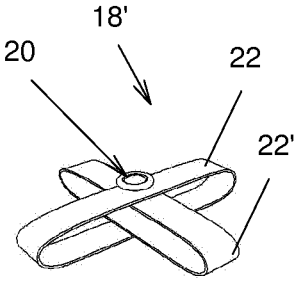
FIG. 10, in a perspective view, illustrates an alternative mount usable in the system of FIG. 1.

The mount 18 includes a mount loop 22 positionable around the gift 12, the wrapping attachment 20 being secured to the mount loop 22. The mount 18 includes a single mount loop 22, but any other suitable mount 18 securable to the gift 12 is usable with the present invention. For example, and non-limitingly, as seen in FIG. 10, mounts 18' including a pair of mount loops 22 and 22' perpendicular to each other are also within the scope of the invention. In this embodiment, the gift 12 would be enclosed by both mount loops 22 and 22' simultaneously when the mount 18' is mounted thereto. In some embodiments, the mount loop 22 is made of a stretchable material. In other embodiments, the mount loop is substantially unstretchable, but can be adjusted in length to fit gifts 12 of different dimensions.

Figure 4:
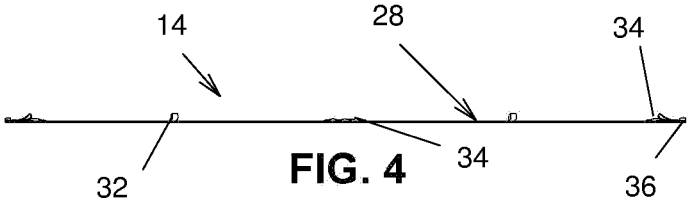
FIG. 4, in a side elevation view, illustrates the wrapping of FIG. 2.
Figure 5:
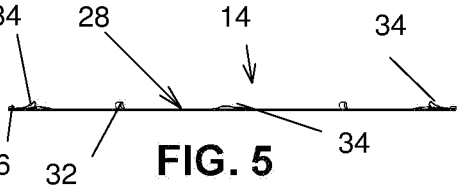
FIG. 5, in a front elevation view, illustrates the wrapping of FIG. 2.
Figure 6:
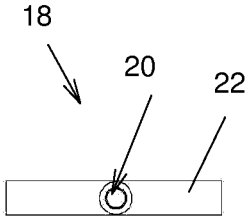
FIG. 6, in a top plan view, illustrates a mount part of the packaging system of FIG. 1.
Figure 7:
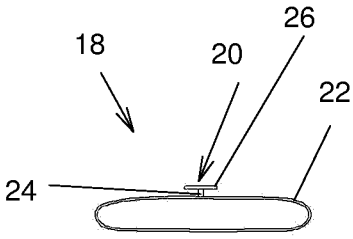
FIG. 7, in a side elevation plan view, illustrates the mount of FIG. 6.
Figure 8:
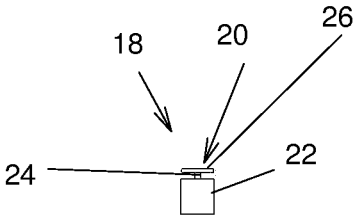
FIG. 8, in a front elevation view, illustrates the mount of FIG. 6.
Figure 9:
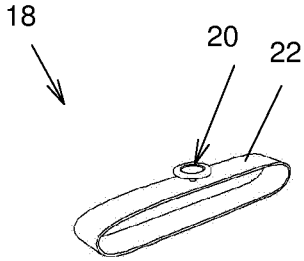
FIG. 9, in a perspective view, illustrates the mount of FIG. 6.

The wrapping attachment 20 is any suitable item that can be inserted in the mounting apertures 16 and that can be maintained therein without being easily accidentally detached therefrom. For example, as seen in FIG. 7, the wrapping attachment 20 includes a stem 24 extending away from the mount loop 22 and a flange 26 protruding transversally from the stem 24, the flange 26 being spaced apart from the mount loop 22. The flange is for example and non-limitingly disc shaped. In the attached configuration, the stem 24 extends through the at least some of the mounting apertures 16. The stem 24 may be substantially rigid or may be substantially freely deformable. In this latter case, the wrapping attachment 20 may take the form of a large button or other similar item sewn or otherwise secured to the mount loop.

Referring to FIG. 1, in some embodiments, the decorative wrapping 14 includes a fabric panel 28 defining a panel peripheral edge 30. The fabric panel 28 may be made of a single piece of material or of may pieces of material sewn or otherwise secured to each other. The different pieces of material may be made of the same fabric or of different fabrics. For example, with reference to FIG. 2, the fabric panel 28 includes a central portion 29 delimited along the panel peripheral edge 30 by a peripheral portion 31, with the central portion 29 being more stretchable than the peripheral portion 31. In some embodiments, the peripheral portion 31 is substantially unstretchable while the central portion 29 is substantially stretchable. However, fabric panels 28 including unstretchable central portions 29 and/or stretchable peripheral portions 31 are usable in alternative embodiments of the invention. For example, completely unstretchable fabric panels 28 are usable in embodiments intended for use with items of substantially similar dimensions, such as wine bottles, among other possibilities. In some embodiments, the fabric panel 28 is continuous and uninterrupted, so that the fabric panel is not provided with any aperture formed thereinto, although fabric panels 28 provided with such apertures, for example to define some of the mounting apertures 16, are within the scope of the invention.

In some embodiments, the fabric panel 28 is substantially polygonal, for example substantially rectangular, and defines edges 33 joined to each other by apexes 35, the edges 33 and apexes 35 forming the panel peripheral edge 30. In some embodiments, the panel peripheral edge 30 is arced at the apexes 35, so that the apexes 35 are shaped similarly to an arc of a circle. In other embodiments, not shown in the drawings, the apexes 35 are angular and define a point or a truncated from ideal pointed apexes in any other suitable manner. Also, the fabric panel 28 may have any other suitable shape, depending on the shape of the items to wrap.

In some embodiments, the decorative wrapping 14 also includes wrapping bands of first, second and third types 32, 34 and 36 secured to the fabric panel 28 and forming the mounting apertures 16, either alone or in cooperation with the fabric panel 28. Although three types of wrapping bands 32, 34 and 36 are described in the present document, in alternative embodiments, the packaging system 10 includes only one or two types from the first, second and third types of wrapping bands 32, 34 and 36, or wrapping bands forming other structures that define the mounting apertures 16. Also, the mounting apertures 16 could be delimited in any other suitable manner in alternative embodiments. The wrapping bands of the first, second and third types 32, 34 and 36 may all be made of the same material, for example of an unstretchable material, or could be made of different materials.

In a very specific and non-limiting embodiment of the packaging system 10, the wrapping bands of the first type 32 are each looped to define one of the mounting apertures 16. The wrapping bands of the first type 32 are each provided at one of the edges 33. For example, the wrapping bands of the first type 32 may be sewn to the peripheral portion 31, or otherwise secured thereto, to point generally inwardly, away from the panel peripheral edge 30.

Figure 11:
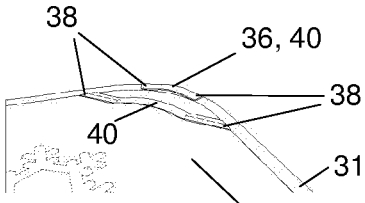
FIG. 11, in a perspective view, illustrates an apex of the wrapping of FIG. 2.

Also, wrapping bands of the second type 34 each extend across part of the fabric panel 28 so that each of the wrapping bands of the second type 34 and the fabric panel 28 cooperatively define one of the mounting apertures 16. The wrapping bands of the second type 34 are for example each provided at one of the apexes 35 and extend between two of the edges 33. The wrapping bands of the second type 34 each define a pair of attached sections 38 sewn or otherwise secured to the fabric panel 28, and a detached section 40 extending therebetween and unattached to the fabric panel 28, as seen in FIG. 11. The detached section 40 and the fabric panel together define the mounting apertures 16. In some embodiments, at least part of the attached sections 38 are secured to the peripheral portion 31, with the latter being substantially unstretchable, to reduce the likelihood of damaging a relatively more fragile stretchable central portion 29.

The wrapping bands of the third type 36 each extend along part of the panel peripheral edge 30, for example along the peripheral portion 31, with a portion thereof unattached to the fabric panel 28 so that each wrapping bands of the third type 36 and the fabric panel 28 cooperatively define one of the mounting apertures 16. Similarly to the wrapping bands of the second type 34, the wrapping bands of the third type 36 each define a pair of attached sections 38 sewn or otherwise secured to the fabric panel 28, at the panel peripheral edge 30 and a detached section 40 extending therebetween and unattached to the fabric panel 28.

A particular configuration of the wrapping bands of the first, second and third types 32, 34 and 36 that has been found to be particularly advantageous is to have a wrapping band of the second type 34 and a wrapping band of the third type 36 at each apex 35. If the decorative wrapping 14 is large enough, wrapping bands of the third type 36 can be provided also between the apexes 35, for example midway therebetween. One or more wrapping bands of the first type 32 are provided between the wrapping bands of the third type 36 if required due to relatively large dimensions of the fabric panel 28. While not present in all embodiments of the invention, this specific configuration, when present, allows for wrapping gifts 12 and other items having a wide range of dimensions with the same packaging system 10.

Figure 12:
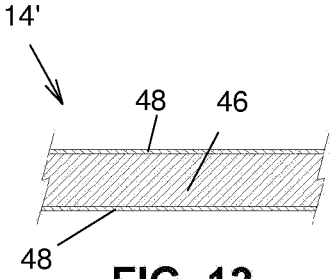
FIG. 12, in a side cross-sectional view, illustrates an alternative embodiment of the wrapping of FIG. 2.

In some embodiments, the packaging system 10 is usable for applications other than gift giving, for example to wrap an item for delivery. In an example of such use, the item includes food that must be preserved cold or hot. In such applications, it can be advantageous to have a wrapping 14' that includes a thermally insulating material 46 sandwiched between two fabric layers 48, as seen in FIG. 12. The thermally insulating material 46 may also be stretchable in some embodiments.

FIGS. 13 to 16 illustrate an example of use of the packaging system 10. This example illustrates wrapping of a gift 12 including three items 12*a*, 12*b* and 12*c*. However, a similar method can be performed for gifts 12 including more than three items 12*a*, 12*b* and 12*c* or less than three items 12*a*, 12*b* and 12*c*.

Figure 14:
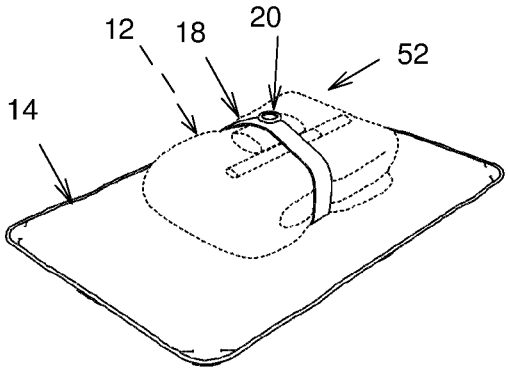
FIG. 14, in a perspective view, illustrates another step in use of the system of FIG. 1 to wrap a gift.
Figure 15:
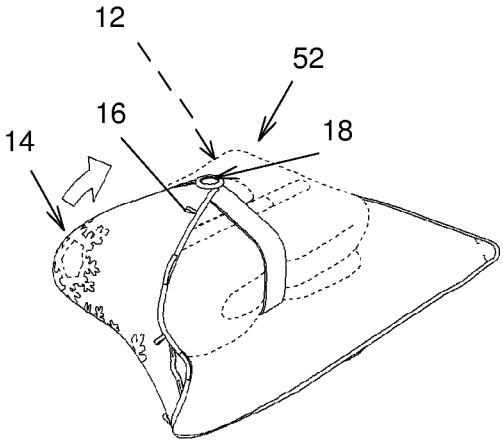
FIG. 15, in a perspective view, illustrates yet another step in use of the system of FIG. 1 to wrap a gift.

First, the decorative wrapping 14 is laid open, for example flat on a surface. If the decorative wrapping 14 is more aesthetic one side thereof, this side faces down. Then, as seen in FIG. 14, the mount 18 is mounted to the gift 12 to make a mounted gift 52, typically with the wrapping attachment 20 facing upward, and the mounted gift 52 is laid on the decorative wrapping 14. Then, the decorative wrapping 14 is folded over the gift 12 to insert successively the wrapping attachment 20 through some or all of the mounting apertures 16 until the decorative wrapping 14 conceals the gift 12, as seen in FIG. 16. The decorative wrapping 14 may then be folded to hide any unattached attachment bands 32, 34 and 36. Unwrapping the gift 12 proceeds by reversing these steps. Also, when possible, some of the above steps can be performed in a different order.

The order in which the attachment bands 32, 34 and 36 are secured to the wrapping attachment 20 is selected to suit the shape and dimensions of the gift 12. For example, all the attachment bands of the second type 34 or all the attachment bands of the third type 36 at the apexes 35 may be successively attached to the wrapping attachment 20, followed by attachment of the wrapping bands of the third type 36 located on the edges 33. In another example, this sequence is reversed. Attachment bands of the first type are particularly useful for wrapping larger items, to avoid having relatively large unattached portions of the fabric panel hanging free after wrapping the gift 12.

Although the present invention has been described hereinabove by way of exemplary embodiments thereof, it will be readily appreciated that many modifications are possible in the exemplary embodiments without materially departing from the novel teachings and advantages of this invention. Accordingly, the scope of the claims should not be limited by the exemplary embodiments, but should be given the broadest interpretation consistent with the description as a whole. The present invention can thus be modified without departing from the spirit and nature of the subject invention as defined in the appended claims.

What is claimed is:

1. A reusable packaging system for a gift, comprising:

a decorative wrapping for wrapping around the gift so that the gift is concealed thereby, the decorative wrapping defining a plurality of mounting apertures; and a mount securable to the gift independently from the decorative wrapping, the mount being provided with a wrapping attachment insertable in each of the mounting apertures;

the decorative wrapping being movable between attached and detached configurations, wherein, in the detached configuration, the decorative wrapping is detached from the mount, and, in the attached configuration, with the mount secured to the gift, the decorative wrapping is attached to the mount and encloses the gift, the decorative wrapping being secured to the wrapping attachment with the wrapping attachment inserted through at least some of the mounting apertures.

2. The reusable packaging system as defined in claim 1, wherein the mount includes a mount loop positionable around the gift, the wrapping attachment being secured to the mount loop.

3. The reusable packaging system as defined in claim 2, wherein the mount loop is a first mount loop, the mount also including a second mount loop substantially perpendicular to the first mount loop, the first and second mount loops being positionable simultaneously around the gift.

4. The reusable packaging system as defined in claim 2, wherein the wrapping attachment includes a stem extending away from the mount loop and a flange protruding transversally from the stem, the flange being spaced apart from the mount loop, wherein, in the attached configurations, the stem extends through the at least some of the mounting apertures.

5. The reusable packaging system as defined in claim 2, wherein the stem is substantially freely deformable.

6. The reusable packaging system as defined in claim 2, wherein the mount loop is resiliently stretchable.

7. The reusable packaging system as defined in claim 1, wherein the decorative wrapping includes a fabric panel defining a panel peripheral edge, the decorative wrapping also including a plurality of wrapping bands secured to the fabric panel, each wrapping band at least partially defining a respective one of the mounting apertures.

8. The reusable packaging system as defined in claim 7, wherein at least one of the wrapping bands is looped to define one of the mounting apertures.

9. The reusable packaging system as defined in claim 8, wherein the fabric panel is substantially polygonal and defines edges joined to each other by apexes, the at least one of the wrapping bands being provided along one of the edges of the fabric panel.

10. The reusable packaging system as defined in claim 7, wherein at least one of the wrapping bands extends across part of the fabric panel so that the at least one of the wrapping bands and the fabric panel cooperatively define one of the mounting apertures.

11. The reusable packaging system as defined in claim 10, wherein the fabric panel is substantially polygonal and defines edges joined to each other by apexes, the at least one of the wrapping bands being provided at one of the apexes of the fabric panel and extending between two of the edges of the fabric panel.

12. The reusable packaging system as defined in claim 7, wherein at least one of the wrapping bands extends along the panel peripheral edge with a portion thereof unattached to the fabric panel so that the at least one of the wrapping bands and the fabric panel cooperatively define one of the mounting apertures.

13. The reusable packaging system as defined in claim 7 wherein at least one of the wrapping bands is made of a substantially unstretchable material.

14. The reusable packaging system as defined in claim 1, wherein the decorative wrapping includes a substantially polygonal fabric panel defining a panel peripheral edge, the fabric panel also defining edges joining pairwise at apexes, the fabric panel including a central portion delimited along the panel peripheral edge by a peripheral portion, the central portion being more stretchable than the peripheral portion; and a plurality of wrapping bands secured to the fabric panel, first bands from a first subset of the wrapping bands being each looped and secured to the fabric panel at the edges and each defining one of the mounting apertures, second bands from a second subset of the wrapping bands extending each across part of the fabric panel at the apexes between two adjacent ones of the edges to define one of the mounting apertures cooperatively with the fabric panel, and third bands from a third subset of the wrapping bands extending each along the panel peripheral edge with a detached part thereof that is unattached to the fabric panel, the fabric panel and the detached part together defining one of the mounting apertures.

15. The reusable packaging system as defined in claim 1, wherein the wrapping bands each have at least a portion thereof secured to the peripheral portion.

16. A reusable packaging system for an item, comprising:

a wrapping for wrapping around the item so that the item is surrounded thereby, the wrapping defining a plurality of mounting apertures; and a stretchable mount loop positionable around the item independently from the wrapping, a wrapping attachment insertable in each of the mounting apertures being secured to the mount loop, the wrapping attachment including a stem extending away from the mount loop and a flange protruding transversally from the stem, the flange being spaced apart from the mount loop;

the wrapping being movable between attached and detached configurations, wherein, in the detached configuration, the wrapping is detached from the mount, and, in the attached configuration, the wrapping is attached to the mount and encloses the item with the mount secured to the gift and with the wrapping secured to the wrapping attachment with the stem inserted through at least some of the mounting apertures.

17. The reusable packaging system as defined in claim 16, wherein the wrapping includes a stretchable central portion and a peripheral portion that is less stretchable than the central portion.

18. The reusable packaging system as defined in claim 16, wherein the wrapping includes a thermally insulating layer sandwiched between two fabric layers.

* * * * *